United States Patent [19]

De Filippis et al.

[11] Patent Number: 4,527,142

[45] Date of Patent: Jul. 2, 1985

[54] DELAYED-ACTION THERMAL RELAY

[75] Inventors: Pietro De Filippis, Aversa; Amedeo Salvatore, Naples; Ciro Calenda, Aversa; Giuseppe Notaro, Pomigliano D'Arco, all of Italy

[73] Assignee: Texas Instruments Incorporated, Dallas, Tex.

[21] Appl. No.: 532,863

[22] Filed: Sep. 16, 1983

[51] Int. Cl.[3] ..... H01H 61/02; H01H 71/16

[52] U.S. Cl. ..... 337/105; 337/102; 361/24

[58] Field of Search ..... 337/102, 103, 105, 107, 337/112; 361/24, 106; 318/783, 791, 788, 792

[56] References Cited

U.S. PATENT DOCUMENTS

| | | | |
|---|---|---|---|
| 4,334,209 | 6/1982 | Dennis | 337/102 |
| 4,365,225 | 12/1982 | Olsen et al. | 337/107 |
| 4,422,120 | 12/1983 | Kobayashi et al. | 361/24 |

*Primary Examiner*—Harold Broome

*Attorney, Agent, or Firm*—James P. McAndrews; John A. Haug; Melvin Sharp

[57] ABSTRACT

A delayed-action thermal relay, particularly for starting single-phase induction motors, comprises a case of insulating material, a first, a second, and a third terminal within the case, an actuator unit consisting of a heating element of a material with positive temperature coefficient and of a bimetal member, and first and second contacts that are normally closed carried by the bimetal and by the third terminal respectively, said actuator unit being forcibly and adjustably inserted between the first and second terminals.

7 Claims, 5 Drawing Figures

DELAYED-ACTION THERMAL RELAY

BACKGROUND OF THE INVENTION

The present invention relates to delayed-action thermal relays, and particularly to delayed-action thermal relays comprising a bimetallic element and a heating element composed of a material having a positive temperature coefficient (PTC).

As is known, single-phase induction or asynchronous electrical motors require special means for overcoming starting obstacles, particularly under load, and then entering into normal running conditions. The starting problem has been solved with various devices one of which provides the use of an additional motor starting winding which is disconnected after the motor has been started. To achieve this result, a relay with normally closed contacts is used which opens after a certain delay.

While the invention will be described as applicable to a relay as defined above and for the purpose indicated above, it should be understood that use in single-phase induction motors (examples of which are compressors for refrigerators and the like) does not exhaust other possibilities of application of such relays, said relays being able to be used effectively in any other application where there is need for a delayed actuation of the relay, i.e. in all circuits that require a certain time delay between actuation and response.

It should be noted furthermore that, while the invention is described with reference to contacts that are normally closed, the device as described can be readily modified to obtain a delayed-action relay with contacts that are normally open as needed for other applications.

SUMMARY OF THE INVENTION

In its preferred embodiment, the present invention comprises a case of insulating material, a first, a second, and a third terminal, an actuator unit consisting of an element or tablet of material having a positive temperature coefficient and of a bimetallic disk, a first contact carried by one of the terminals, and a second contact carried by the bimetallic disk, said actuator unit being operatively inserted in a force fit between the other two terminals yet so as to be adjustable between the other two terminals.

The forced insertion of the unit consisting of the PTC tablet and the bimetallic disk has the purpose of assuring optimal thermal connections which, in turn, assure constancy of the operating or delay times provided by the device. Such forced insertions can be achieved, for example, in that the engagement between the tablet of material with positive temperature coefficient and its associated terminal is effected with a deformable end piece of said terminal, while adjustments of such forced insertion are achieved subsequently by means of a screw or the like which regulates the engagement between the bimetal and its associated terminal.

A further possibility for adjustment consists of acting on the terminal supporting the contact, leaving the terminal engaging the PTC element completely rigid.

In a preferred embodiment of the invention, the travel of the bimetallic element is defined or limited by fixed reference points made on the case, the reference points having the double purpose of facilitating reclosing of the contacts after the device has been disconnected, and of significantly reducing mechanical stresses on the bimetal so as to greatly increase its useful life, as expressed as a number of cycles before breakage.

The bimetal used in the relay of the present invention is of the preformed type, provided with two distinct characteristic temperatures of response at which, at the snap-action points, a mechanical reversal of its curvature takes place.

Contrary to the starting devices already known being mostly electromagnetic devices functioning of which is a function of the current passing through them, the functioning of the delayed action thermal relay of the present invention is substantially independent of the load current and at the same time practically insensitive to the normal variations of the power voltage.

DESCRIPTION OF THE DRAWINGS

Other objects, features and advantages of the present invention will become apparent to those skilled in the art from the following detailed description and from the attached drawings which show a preferred embodiment of the invention, it being understood that said embodiment is given by way of example and in no way restricts the scope of the invention thereto.

In the said drawings.

DESCRIPTION OF THE PREFERRED EMBODIMENTS

Figure 1:
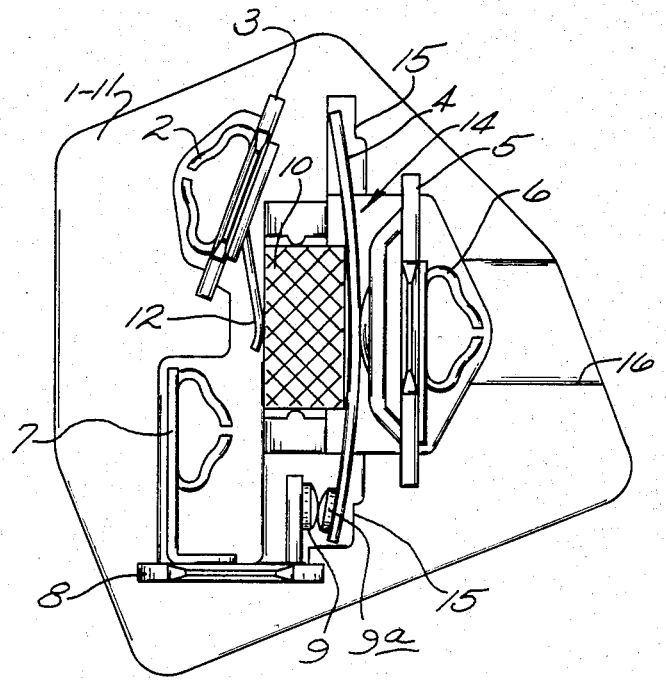
FIG. 1 shows a top view of the inside of the relay with all its component elements.
Figure 2:
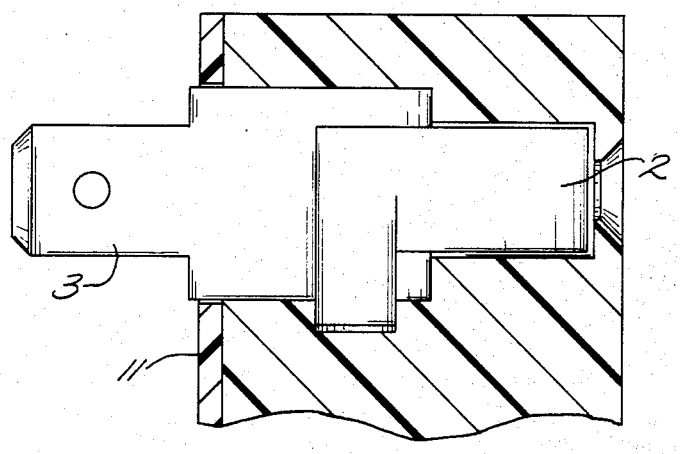
FIG. 2 shows a sectional view along line A—A of FIG. 1.

Referring now to the drawings, and especially to FIG. 1 thereof, it is seen that the thermal relay of the present invention comprises a case 1 of insulating material, closed by a lid 11 (not shown in FIG. 1) secured to the case in any conventional manner. Inside the case 1, three terminals 2, 6 and 7 are housed with three end pieces 3, 5 and 8 of the terminals respectively secured thereto which extend from the case for connection to the electrical outlets. Between the first terminal 2, 3 and the second terminal 5, 6, an actuator unit 14 is operatively connected, said actuator unit comprising a bimetallic disk 4 and a heater tablet or wafer 10 of a ceramic material or the like with a positive temperature coefficient (PTC) having ohmic contact means (not shown) located on respective opposite flat faces of the wafer. The wafer material has a low initial resistance and is adapted to display a much greater resistance when heated.

The third terminal 7, 8 carries a stationary contact 9 which is to engage with a movable contact **9*a* carried at an end of the bimetallic element 4. When in the resting position as shown in FIG. 1, the two contacts 9, 9*a* are closed. Upon connecting the terminals 2, 6 and 7 to the respective common, main winding and start winding terminals of a refrigerator-compressor motor for example, and on connecting terminal end pieces 3 and 5 to the respective line terminals of a power source, electrical power is directed between terminals 2 and 6 and the tablet or wafer 10 heats up and transfers part of the heat produced to the bimetallic element 4. The heating up of the wafer 10** increases its resistance to its high resistance state such that the heated wafer self-regulates and stabilizes its temperature at a safe level substantially reducing current flow in the wafer. In the arrangement thus described, the start and main windings of the compressor motor are both energized for starting the motor.

Utilizing the characteristics of the wafer 10 and bimetallic element 4 which is thermally coupled to the former, the heat furnished during operation of the wafer 10 to bimetallic element 4 causes the latter to reach its first temperature of response at which it snaps over thereby tending to reverse its original predetermined curvature. This results in an opening of the circuit between the two contacts 9, 9*a* for deenergizing the start winding of the motor.

As seen particularly in FIG. 1, the bimetallic element 4 is mounted inside case 1 with the ends of the bimetal inserted into clearly-defined wells so as to provide fixed stop references 15 that limit the travel of the bimetallic element in response to heating thereof. As already mentioned above, the delimitation of travel of the bimetallic element has the double purpose of keeping the bimetallic element in a position predisposed for restoring the contacts to their closed condition after the device has been disconnected and wafer 10 cooled down, and of assuring minimal mechanical stresses of the bimetal and thus a substantial extension of its useful life.

As concerns the disposition of the wafer-bimetal unit 14 between terminals 2, 3 and 5, 6, it should be pointed out that this disposition achieves an optimal thermal connection between the wafer and the bimetal. This disposition is obtained as a result of the pressure the elastic end piece 12 of the terminal 2 exercises through forced deformation against one face of the wafer 10. In this way, the tolerances of the components which thus exert the pressure necessary to minimize thermal losses are compensated for. With this optimized thermal connection the constancy of the operating times is assured.

Figure 3:
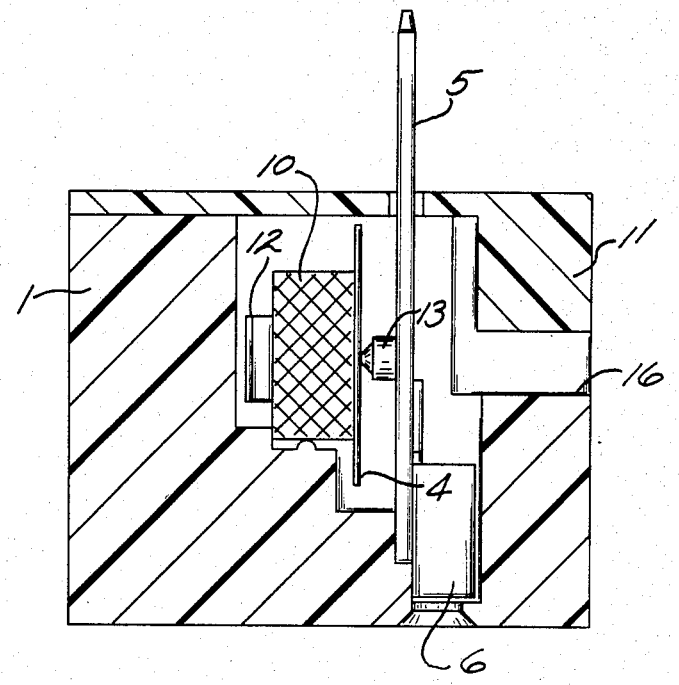
FIG. 3 shows a sectional view along line B—B of FIG. 1.
Figure 4:
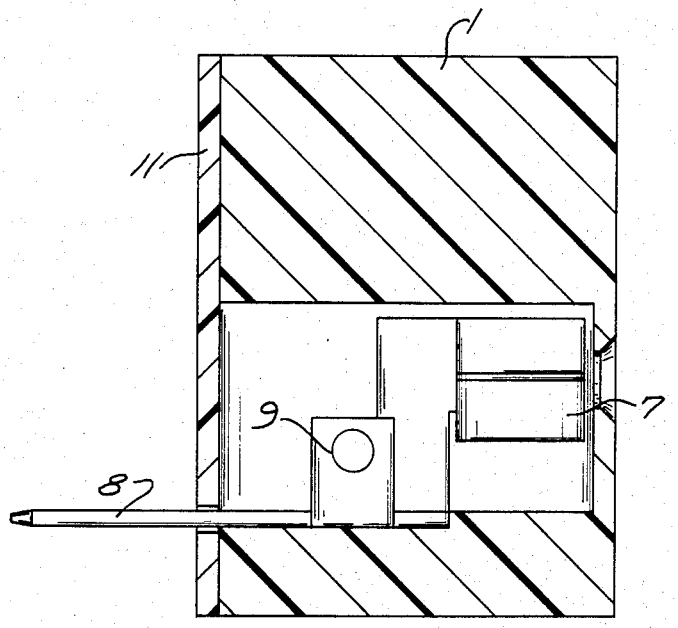
FIG. 4 shows a sectional view along line C—C of FIG. 1.
Figure 5:
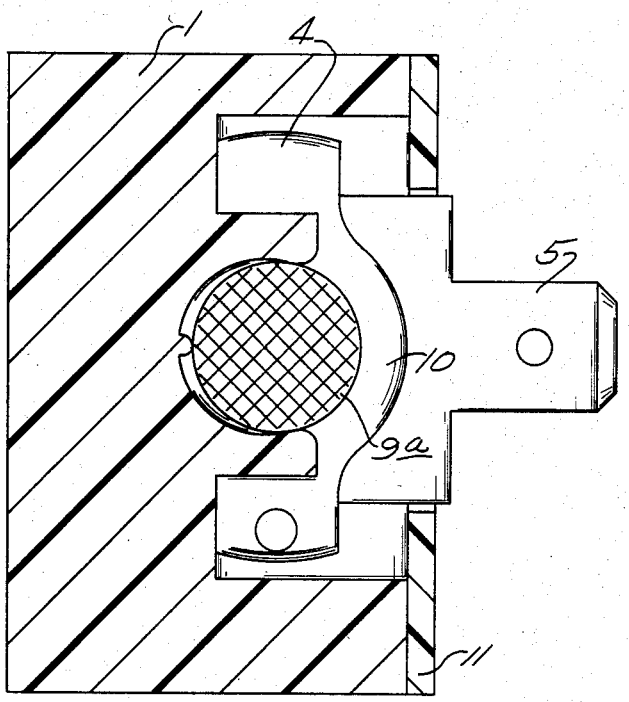
FIG. 5 shows a sectional view along line D—D of FIG. 1.

The time intervening between connecting the power and opening of the contacts is predetermined through calibration of the response times of the bimetal acting on terminal 5, 6 which is in contact with the bimetallic element 4 by means of a piece 13 of the terminal end piece 5 (FIG. 3). If desired, an adjusting screw (not shown) accessed through slot 15 acts at the center of the bimetallic element or the piece 13, or adjustment of device operating time can be made by means of an appropriate deformation of terminal 5, 6 at piece 13 or the like.

The present invention has been described by reference to a preferred embodiment thereof, but it goes without saying that those skilled in the art may make changes and modifications in the contructional details without for that matter departing from the scope of the present invention.

We claim:

1. A delayed-action thermal relay, particularly for starting single-phase induction motors having main and start windings, comprising a case of insulating material; a first, a second, and a third terminal mounted on the case, for connecting the windings in an electrical circuit to a power source, and thermally-responsive actuator means for the relay characterized in that the actuator means comprises an electrical resistance heating element and a bimetallic disk having the heating element disposed in heat-transfer relation to the disk; a first contact is carried by the third terminal and a second contact is carried by the bimetallic disk to be moved into and out of engagement with the first contact to control energizing of the start winding of the motor; and the heating element and bimetallic disk are engaged with each other and forcibly fitted in an operative position between the first and second terminals to engage and electrically connect the heating element and disk to the first and second terminals respectively for permitting selective energizing and deenergizing of the heating element to move the bimetallic disk to regulate the engagement and disengagement of the contacts.

2. A delayed-action relay as set forth in claim 1 further characterized in that said heating element comprises a tablet composed of a material having a positive temperature coefficient.

3. A delayed-action relay as set forth in claim 1 further characterized in that said bimetallic disk is preformed with an original predetermined curvature and reverses its predetermined curvature when heated to a selected response temperature.

4. A delayed-action relay as set forth in claim 3 further characterized in that the case has wells made therein and said preformed bimetallic disk is fitted between the first and second terminals inside said case with its ends inserted in the wells made in the case, said wells forming fixed stop reference points to delimit the travel of the bimetallic disk in response to heating thereof.

5. A delayed-action relay as set forth in claim 1 further characterized in that the first terminal has an elastic end piece portion and the forced fit insertion of the heating element and bimetallic disk between the first and second terminals is achieved by means of deformation of the end piece of the first terminal which presses against one face of the heating tablet to optimize engagement and thermal connection of the tablet to the bimetallic disk.

6. A delayed-action relay as set forth in claim 5 further characterized in that said forced fit insertion of the heating element and bimetallic disk between the first and second terminals is adjustable by bending of said end piece of the first terminal for regulating actuating time of the relay.

7. A thermal control device comprising a case of insulating material; a first, a second, and a third terminal mounted on the case for connecting a power source in an electrical circuit, and thermally-responsive actuator means for the control device characterized in that the actuator means comprises an electrical resistance heating element and a bimetallic disk having the heating element disposed in heat-transfer relation to the disk; a first contact is carried by the third terminal and a second contact is carried by the bimetallic disk to be moved into and out of engagement with the first contact; and the heating element and bimetallic disk are engaged with each other and forcibly fitted in an operative position between the first and second terminals for permitting selective energizing and deenergizing of the heating element to move the bimetallic disk to regulate the engagement and disengagement of the contacts.

* * * * *